US007103929B2

(12) United States Patent
Pilling et al.

(10) Patent No.: US 7,103,929 B2
(45) Date of Patent: Sep. 12, 2006

(54) DISPOSABLE BEDDING WITH ABSORBENT REGION

(75) Inventors: Melanie Pilling, Green Bay, WI (US); David Pisani, Green Bay, WI (US)

(73) Assignee: Little Rapids Corporation, Green Bay, WI (US)

( * ) Notice: Subject to any disclaimer, the term of this patent is extended or adjusted under 35 U.S.C. 154(b) by 0 days.

(21) Appl. No.: 10/388,077

(22) Filed: Mar. 12, 2003

(65) Prior Publication Data

US 2003/0172457 A1 Sep. 18, 2003

Related U.S. Application Data

(60) Provisional application No. 60/365,000, filed on Mar. 12, 2002.

(51) Int. Cl.
*A47G 9/00* (2006.01)

(52) U.S. Cl. ..... 5/487; 5/484; 5/500

(58) Field of Classification Search ..... 5/487, 5/484, 500

See application file for complete search history.

(56) References Cited

U.S. PATENT DOCUMENTS

| | | | | | |
|---|---|---|---|---|---|
| 1,959,920 | A | | 5/1934 | Kaiser | |
| 2,707,289 | A | * | 5/1955 | Taggart | 5/484 |
| 3,321,782 | A | | 5/1967 | Hrubecky et al. | |
| 3,407,414 | A | * | 10/1968 | Burns et al. | 5/487 |
| 3,591,875 | A | * | 7/1971 | Zipf et al. | 5/487 |
| 3,646,624 | A | | 3/1972 | Zipf, III | |
| 3,761,973 | A | * | 10/1973 | Leventhal | 5/484 |
| 4,064,577 | A | | 12/1977 | Walters | |
| 4,461,048 | A | | 7/1984 | Allaire, Jr. | |
| 4,524,474 | A | * | 6/1985 | Svensson | 5/484 |
| 4,704,753 | A | | 11/1987 | Lunt | |
| 4,744,118 | A | | 5/1988 | Lunt | |
| 4,813,944 | A | * | 3/1989 | Haney et al. | 604/358 |
| 4,886,697 | A | * | 12/1989 | Perdelwitz et al. | 428/192 |
| 4,892,353 | A | | 1/1990 | Goddard | |
| 4,923,453 | A | | 5/1990 | Bullard, Jr. | |
| 4,961,982 | A | * | 10/1990 | Taylor | 428/91 |
| 5,081,729 | A | | 1/1992 | Menday | |
| 5,099,532 | A | * | 3/1992 | Thomas et al. | 5/484 |
| 5,189,744 | A | | 3/1993 | Roberts | |
| 5,252,374 | A | * | 10/1993 | Larsonneur | 428/77 |
| 5,384,923 | A | | 1/1995 | Hwang et al. | |
| 5,572,754 | A | | 11/1996 | Lazar et al. | |
| 5,615,425 | A | | 4/1997 | Corente | |
| 5,701,617 | A | * | 12/1997 | Colby | 5/484 |
| 5,774,890 | A | | 7/1998 | Shah | |
| 5,787,523 | A | * | 8/1998 | Lindberg | 5/81.1 HS |
| 5,920,929 | A | | 7/1999 | Hensley et al. | |
| 6,128,796 | A | | 10/2000 | McCormick et al. | |
| 2003/0121101 | A1 | * | 7/2003 | Corzani et al. | 5/487 |

* cited by examiner

*Primary Examiner*—Frederick L. Lagman
(74) *Attorney, Agent, or Firm*—Nicholas A. Kees; Godfrey & Kahn, S.C.

(57) ABSTRACT

A disposable sheet has a draw sheet or chux attached thereto. Preferably, the chux is constructed from three layers, a bottom, middle and top layer. The top layer is moisture permeable and the middle layer is absorbent. The top layer of the chux and the sheet itself may be integrally connected. Fluids flow through the chux top layer to the middle layer. The chux bottom layer may be waterproof to prevent fluids from leaving the middle layer. A quilted pattern may be applied to the chux to for aesthetic reasons or to direct fluid flow.

6 Claims, 2 Drawing Sheets

DISPOSABLE BEDDING WITH ABSORBENT REGION

RELATED APPLICATIONS

This is a non-provisional application that claims priority under 35 U.S.C. §19(e) from U.S. patent application Ser. No. 60/365,000 Mar. 12, 2002, which is incorporated herein by reference.

FIELD OF THE INVENTION

The present invention relates to bedding, particularly disposable bedding that has an absorbent region to collect fluids.

BACKGROUND OF THE INVENTION

In emergency operations occasioned by accidents, war or natural disasters, the injured or dead need to be transported by ambulances and paramedic units. Most typically, patients are transported from accident sites to medical care facilities by gurneys or other patient bearing structures. During such patient transfers, potentially infectious biological fluids, such as blood, urine, vomit and mucus, may soak into gurney mattresses or the like, thereby increasing susceptibility to infection for occupants, as well as for medical practitioners and facility personnel. Gurney mattresses can be difficult to disinfect.

To overcome the problem of contamination of gurneys and/or gurney mattresses, disposable draw sheets or "chux" are placed under the patient at a point where the bodily fluids may be deposited. However, in emergency and even non-emergency situations, it may be difficult to lift the patient to get the chux under the patient's body. Even if the chux is placed onto the mattress prior to occupancy of the patient, it is easy to shift the chux while placing the patient onto the mattress so that it is no longer in optimal position. Further, a restless patient may cause the chux to shift during transport. Either way, the chux may not be in an optimal position to collect bodily fluids, and contamination of the mattress personnel or facility may result.

U.S. Pat. No. 5,572,754 to Lazar et al. discloses a hospital sheet that has hook fasteners thereon to keep a draw sheet in place. The disadvantage this sheet presents is that the draw sheet must still be purposefully placed under the patient's body. If it is not aligned properly with the fasteners, it may still shift.

Accordingly, there is a need for a disposable sheet that has an absorbent region that cannot shift during use.

SUMMARY OF THE INVENTION

The present invention provides for disposable sheet that has a chux attached thereto and which solves the problems raised or not solved by existing designs.

The disposable sheet of the present invention is basically constructed from a sheet that has a chux attached thereto. Preferably, the chux is constructed from three layers, a bottom, middle and top layer. The top layer is moisture permeable and the middle layer is absorbent. Therefore, fluids may flow through to top layer to the middle layer. The bottom layer is preferably waterproof to prevent fluids from leaving the middle layer.

In one embodiment of the invention, the top layer of the chux is the sheet itself and the bottom layer is a waterproof barrier that attaches to at least the bottom of the chux and may extend to cover the entire bottom surface of the sheet. Thus, at least the top layer of the chux is integrally connected to the sheet. A quilted pattern to provide decoration and possible direct fluid flow may be applied to the chux with a heat seal or the like.

In another embodiment of the invention, the bottom layer of the chux is attached to the top surface of the sheet. The top layer of the chux is a moisture-permeable material and the bottom layer a waterproof material. The middle layer is absorbent. A heat seal or the like may make the attachment of the chux to the sheet. Again, the heat seal may form a quilted pattern.

While one possible application of the present invention is in connection with a medical setting, many other applications are possible and references to use in connection in a medical setting should not be deemed to limit the uses of the present invention. These and other objects and advantages of the present invention will become apparent from the detailed description, claims, and accompanying drawings.

DESCRIPTION OF THE PREFERRED EMBODIMENTS

Figure 1:
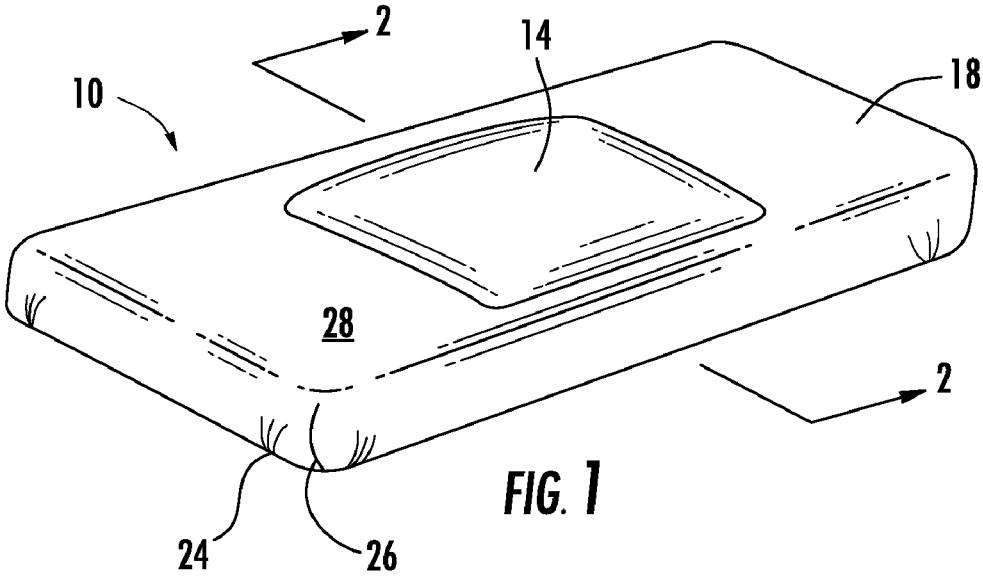
FIG. 1 is a perspective view of one embodiment of the disposable sheet of the present invention.

The present invention, referred to generally as absorbent bedding 10, is generally a chux portion 14 that is affixed or integral to a disposable sheet 18. In a first embodiment shown in FIGS. 1 and 2, a chux 14 is adhered to the top surface of a disposable sheet 18. In another embodiment of the present invention shown in FIGS. 3 and 4, a chux 20 is integrally formed into a disposable sheet 22.

Figure 2:
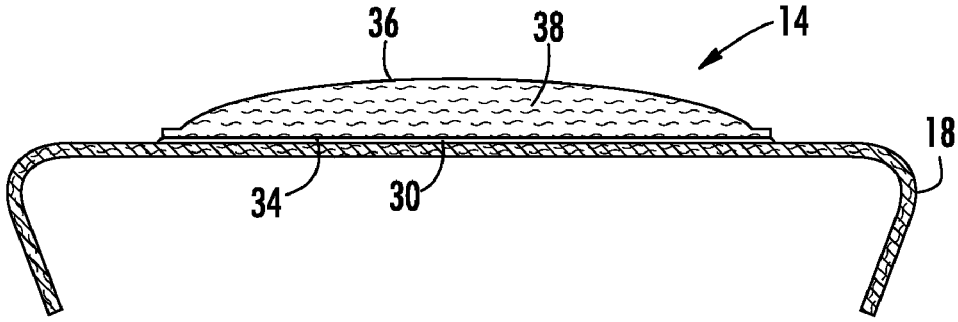
FIG. 2 is a cross section of the sheet, taken at line 2—2 in FIG. 1.

Referring now to FIGS. 1 and 2, the sheet in the invention device is preferably made of a tear-resistant, foldable, and lightweight fabric. Preferably, the sheet is fabricated from a disposable non-woven material, however woven fabrics may be used. The material most preferred for fabrication of the sheet in a waterproof version of the invention is a spunbond-meltblown-spunbond ("SMS") backed with polyethylene moisture barrier. However, the moisture barrier is optional. The sheet is temporarily attached to a mattress (not shown), and is contoured to fit the mattress by shaping the corners with straps (not shown) or elastic to create a gathered portions 24. The gathered portions 24 may be different in number from that shown, and may be placed in different areas along the edge of the mattress. In addition, the sheet may have a corner seam that is contoured for a particular type of mattress.

Attached to the top surface 28 of sheet 18 is the chux 14. The attachment may be achieved by applying an adhesive layer 30 between the chux 14 and sheet 18. Alternatively, the chux 14 may be attached to sheet 18 with a heat seal or stitching (neither shown). The heat seal may be obtained using ultrasonic sealing/welding equipment. Therefore, heat seal and ultrasonic seal will be considered one and the same for the purposes of this invention.

The chux 14 preferably has three layers, a bottom layer, a middle layer and a top layer. The bottom most layer attached to sheet 18 is a waterproof layer 34 such as polyethylene or the like. The top most layer 36 is a material that is resistant to tearing, water-permeable, and may feel relatively dry to the touch even after fluid has passed through. Preferably, layer 36 is spunbonded nonwoven or the like. The middle layer 38 an absorbent material, preferably absorbent fibers such as tissue grade paper, cellulosic batting or the like. A super absorbent powder such as that used in diapers or feminine napkins may be combined with these materials to increase absorbency of the region. Alternatively, the middle layer 38 may be constructed from nonwoven or woven textiles.

Chux 14 is shown in a central position with respect to sheet 18. However, chux 14 may be placed anywhere on sheet 18, and may vary in size or shape.

Figure 3:
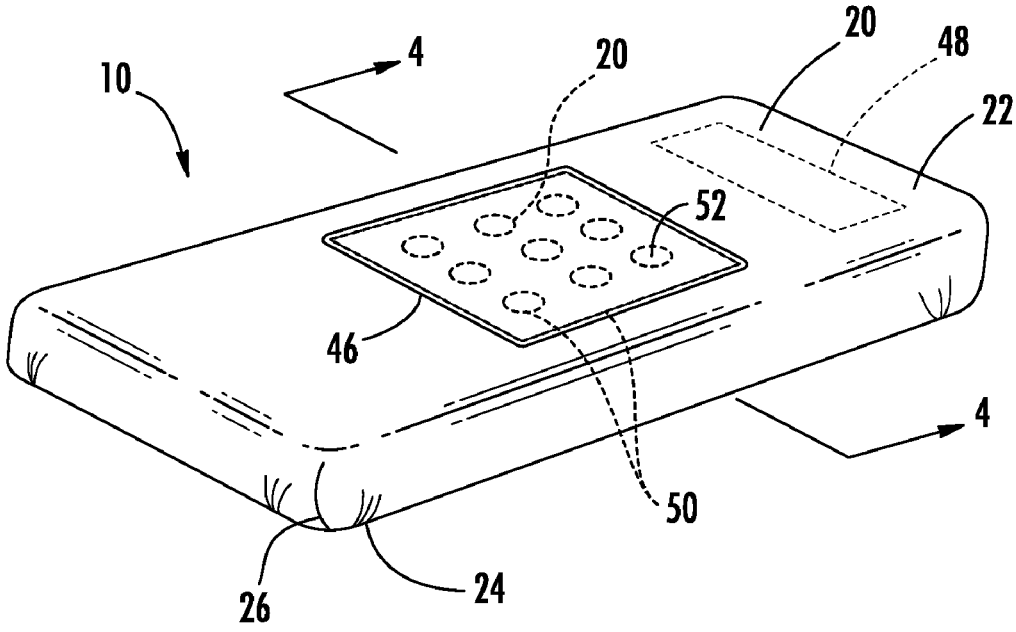
FIG. 3 is a perspective view of another embodiment of the disposable sheet of the present invention.
Figure 4:
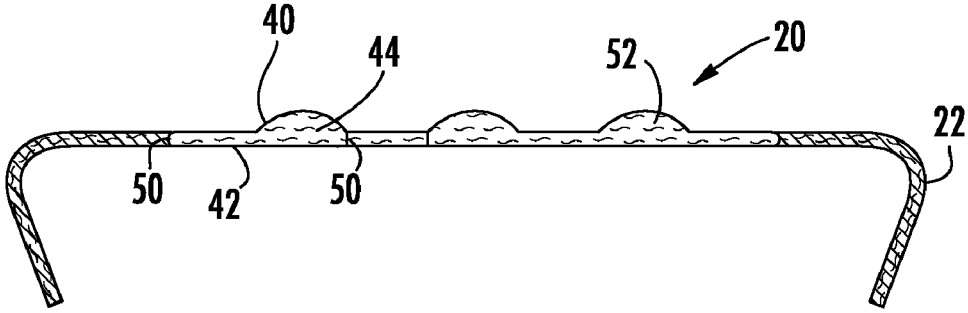
FIG. 4 is a cross section of the sheet, taken at line 4—4 in FIG. 3.

Referring now to the embodiment shown in FIGS. 3 and 4, chux 20 is integrally formed into the sheet 22. Preferably, sheet 20 is constructed from a spunbonded nonwoven layer 40 completely backed with a polyethylene layer 42. On at least one region of the sheet, an absorbent layer 44 is deposited between layers 40 and 42. For example, shown in FIG. 3 is a region 46 that may be positioned under a patient's hip region, and a region 48 that may be positioned under a patient's head.

Regions 46 and 48 are preferably formed by applying a heat seal 50 at various points to make a border around the absorbent material 44. This heat seal may also be applied at various points within the regions 46 and 48 to add a quilting effect.

The quilting effect may be merely decorative, or may function to add comfort or to direct the flow of fluids into the center of the region. The thickness of region 48 may be such that it doubles as a pillow. In the example shown in FIG. 4, region 46 is shown to vary in thickness. This varying thickness can direct fluid flow, depending on the pattern of varying thickness. As seen in FIG. 3, a heat seal 50 is applied around the areas 52 of extra thickness to direct fluid flow to various points on the person. Of course, the invention is not limited to the pattern shown in FIG. 3. The pattern used may have continuous lines to actually create flow channels.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A disposable bedding article to be stored in an emergency vehicle and used to cover a mattress having a top surface and sides, the article comprising:

a sheet with a top surface and a bottom surface, with a waterproof material attached to the bottom surface and a chux attached to the top surface;

wherein the chux is comprised of three layers, a bottom layer, a top layer and a middle layer; and wherein the top layer is a moisture-permeable material and the middle layer is an absorbent material so the fluids may pass from the top layer to the middle layer; and wherein when the sheet is positioned on the mattress, the sheet covers the entire top surface of the mattress and extends over the sides of the mattress, and the chux covers only a distinct region of the top surface of the sheet, the distinct region entirely on the top surface of the mattress and not extending to the mattress sides.

2. The disposable bedding article of claim 1 wherein the chux is attached to the sheet with a heat seal.

3. The disposable bedding article of claim 2 wherein the heat seal is applied in a quilted pattern.

4. The disposable bedding article of claim 3 wherein the quilted pattern may be arranged to direct fluid flow.

5. The disposable bedding article of claim 4 wherein the top layer of the chux and the sheet is made from a spunbond-meltblown-spunbond material.

6. A disposable bedding article used to cover a mattress having a top surface and sides, the article comprising:

a sheet made of moisture permeable material, the sheet having a top surface and a bottom surface, wherein the sheet is large enough to cover the top surface of the mattress and at least of portion of the mattress sides;

a chux comprised of an absorbent layer of material, wherein the chux is attached to a particular region of the bottom surface of the sheet, wherein the area of the particular region is less than the area of the top surface of the mattress; and a waterproof barrier attached the bottom surface of the sheet and the bottom layer of the chux so that the chux is sandwiched between the sheet and the waterproof barrier.

* * * * *